US009497548B2

(12) United States Patent
Miyata

(10) Patent No.: US 9,497,548 B2
(45) Date of Patent: Nov. 15, 2016

(54) MOVING-COIL TYPE STEREO PICKUP CARTRIDGE

(71) Applicant: KABUSHIKI KAISHA AUDIO-TECHNICA, Machida-shi, Tokyo (JP)

(72) Inventor: Mitsuo Miyata, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/958,242

(22) Filed: Dec. 3, 2015

(65) Prior Publication Data

US 2016/0192080 A1 Jun. 30, 2016

(30) Foreign Application Priority Data

Dec. 25, 2014 (JP) ..... 2014-262384

(51) Int. Cl.

| | |
|---|---|
| ***H04R 9/12*** | (2006.01) |
| ***H04R 11/08*** | (2006.01) |
| ***H04R 9/16*** | (2006.01) |
| *H04R 11/12* | (2006.01) |
| *H04R 19/10* | (2006.01) |
| *H04R 17/08* | (2006.01) |
| *H04R 9/02* | (2006.01) |

(52) U.S. Cl.

CPC *H04R 9/12* (2013.01); *H04R 9/16* (2013.01); *H04R 11/08* (2013.01); *H04R 9/025* (2013.01); *H04R 11/12* (2013.01); *H04R 17/08* (2013.01); *H04R 19/10* (2013.01)

(58) Field of Classification Search

CPC ..... H04R 1/16; H04R 1/18; H04R 11/08; H04R 11/12; H04R 17/18; H04R 19/40; H04R 9/12; H04R 9/16

See application file for complete search history.

(56) References Cited

U.S. PATENT DOCUMENTS

| | | | | |
|---|---|---|---|---|
| 4,209,670 A * | 6/1980 | Ono | ..... | H04R 9/16 369/136 |
| 4,251,695 A * | 2/1981 | Ono | ..... | H04R 9/16 369/136 |
| 4,263,483 A | 4/1981 | Obata | | |
| 4,374,433 A * | 2/1983 | Ogawa | ..... | H04R 9/16 369/136 |

FOREIGN PATENT DOCUMENTS

| | | |
|---|---|---|
| JP | S51-14002 | 2/1976 |
| JP | S51-034406 U | 3/1976 |
| JP | S52-10105 A | 1/1977 |

OTHER PUBLICATIONS

Europe Patent Office, "Search Report for European Patent Application No. 15201693.7," May 9, 2016.

* cited by examiner

*Primary Examiner* — Carlos E Garcia
(74) *Attorney, Agent, or Firm* — Manabu Kanesaka

(57) ABSTRACT

Provided are a vibration unit which includes a pair of right and left coils that vibrate in response to vibration of a stylus attached to a cantilever and a magnetic circuit which includes a magnet and a pair of yokes and forms a magnetic path. The coils to be disposed in a gap between the pair of yokes are flat coils having perfect circular shapes, and V-shaped notches are formed on opposing surfaces, with the coils interposed therebetween, of the pair of yokes 4. An intersection angle of the V-shaped notch is set to be an angle to allow channel separation between right and left output signals to be obtained by the pair of coils to be equal to or larger than 20 db.

12 Claims, 4 Drawing Sheets

MOVING-COIL TYPE STEREO PICKUP CARTRIDGE

RELATED APPLICATIONS

The present application is based on, and claims priority from, Japanese Application No. JP2014-262384 filed Dec. 25, 2014, the disclosure of which is hereby incorporated by reference herein in its entirety.

BACKGROUND OF THE INVENTION

Field of the Invention

This invention relates to a moving-coil type pickup cartridge that extracts a signal from a 45-45 stereo record, and particularly to a moving-coil type stereo pickup cartridge capable of obtaining a high productivity and a uniform quality by utilizing a generating coil with a simple shape and, and further, reducing crosstalk between right and left output signals.

Description of the Related Art

An iron-core type and an air-core type, roughly divided, have been proposed as moving-coil type stereo pickup cartridges (hereinafter, also referred to simply as MC cartridges).

The iron-core type MC cartridge, which is the former, has a representative one that is called Ortofon type in which a ferromagnetic body is used as a winding core of a generating coil referred to as an armature. Accordingly, the iron-core type has a characteristic that generation efficiency of a signal is favorable, and thus, has been employed in the majority of the MC cartridge.

On the other hand, the air-core type MC cartridge, which is the latter, has a technical problem that the generation efficiency of the signal is low, but a reproduced signal thereof is hardly influenced by magnetostriction (hysteresis distortion) caused by a ferromagnetic body to be employed in the iron-core type described above.

Accordingly, the air-core type MC cartridge is said to be capable of obtaining a more straightforward reproduced sound without any quirk in tone of the reproduced sound, and thus, there is a deep-seated popularity among enthusiasts.

In a power generation mechanism of the moving-coil type pickup cartridge described above, a record signal is picked up by a stylus, a generating coil in a magnetic circuit is vibrated by a cantilever so that a signal voltage is output to both end portions of the generating coil as it is well-known.

However, there is a technical problem that deflection of the cantilever or distortion by moment is caused to impair a sound quality due to the power generation using the cantilever. Further, the generating coil is disposed in a root portion of the cantilever, and thus, an amplitude operation of the generating coil is smaller than amplitude of a sound track engraved on a record, and accordingly, the generation efficiency is extremely low.

Thus, an MC cartridge, which is the air-core type MC cartridge and in which a generating coil is disposed in the middle of a cantilever to improve generation efficiency without impairing a sound quality has been proposed, and such a proposal is disclosed in U.S. Pat. No. 4,374,433 (Patent Literature 1), JP 52-10105 A (Patent Literature 2), JP 51-14002 A (Patent Literature 3), JP 51-34406 U (Patent Literature 4), or the like.

Meanwhile, it is desirable that such a type of MC cartridge have an extremely low impedance of the generating coil serving as a source to generate a signal and be capable of obtaining high output. It is said that it is possible to provide each requirement such as a wide dynamic range, high transient value, low distortion or a high S/N ratio when the above-described conditions are prepared.

With respect to this, an MC cartridge disclosed in Patent Literature 1 described above employs a configuration in which printed coils each of which is formed in an octagonal shape are used as generating coils. According to such a configuration, an impedance of the generating coil serving as a signal source is large while an effective mass as the generating coil is small, and as a result thereof, it is difficult to prepare the requirements described above as the MC cartridge.

In addition, an MC cartridge disclosed in Patent Literature 2 described above employs a configuration in which right and left generating coils, each of which has a triangular shape with rounded angles (so-called Japanese rice ball type), are attached to both opposing end portions of an armature which is formed in a pantograph and connected to a cantilever.

According to such a configuration, it is difficult to produce a delicate mechanism of the pantograph-like armature and the generating coil of the so-called Japanese rice ball type, and thus, it is difficult to obtain the MC cartridge having a high productivity and a uniform quality.

Further, an MC cartridge disclosed in Patent Literatures 3 and 4 described above employs a configuration in which a generating coil of one channel and a generating coil of the other channel are wound while being superimposed on each other to cross each other in a grid pattern.

According to such a configuration, the generating coils are wound while being superimposed on each other in the grid pattern using a quadrilateral winding frame, and thus, a winding operation of the right and left generating coils is complicated and not easy. Accordingly, similarly, it is difficult to obtain the MC cartridge having a high productivity and a uniform quality.

SUMMARY OF THE INVENTION

This invention has been made by placing a focus on the technical problems of the conventional moving-coil type stereo pickup cartridges disclosed in Patent Literatures described above, and an object thereof is to obtain a moving-coil type stereo pickup cartridge capable of obtaining a high productivity and a uniform quality by utilizing a generating coil having a simple shape.

In addition, an object of the invention is to provide the moving-coil type stereo pickup cartridge which has a configuration in which it is possible to obtain high output with extremely low impedance of the generating coil and is capable of effectively reducing crosstalk between right and left channels.

A moving-coil type stereo pickup cartridge according to the present invention in order to achieve the above-described object includes: a vibration unit which includes a cantilever, a stylus attached to the cantilever, and a pair of right and left coils that is attached to the cantilever and vibrates in response to vibration of the stylus; and a magnetic circuit which includes a magnet and a pair of yokes and forms a magnetic path, wherein a gap is formed between the pair of yokes, the coil is disposed in the gap, and further the magnetic path passes through the gap, the coil is a flat coil having a perfect circular shape, V-shaped notches are formed respectively on opposing surfaces, with the coils interposed therebetween, of the pair of yokes, and an intersection angle θ of the V-shaped notch is set to an angle that allows channel separation between right and left output signals to be obtained by the pair of coils is equal to or larger than 20 db.

In this case, according to a preferred form, the pair of right and left flat coils is disposed along a surface of a coil supporting body made of a non-magnetic body attached to a front end portion of a cantilever right above the stylus.

In addition, it is desirable that the coils be disposed in the coil supporting body such that each center of the pair of right and left flat coils having a perfect circular shape and an axial core of the cantilever form an isosceles triangle.

Further, it is possible to preferably use a self-bonding wire, as the pair of right and left flat coils, which can be formed by allowing a coated conductor wire, to which an adhesive is attached, to be firmly wound in a circular shape.

Meanwhile, it is desirable that in the pair of yokes thick portions be formed at an inner side of a gap portion thereof. Further, each of the pair of coils is disposed to include apart that intersects a magnetic flux caused by the magnetic path and a part that does not cut the magnetic flux due to the V-shaped notch. In this case, each of the pair of coils has a perfect circular shape and is disposed such that each center of the coils is positioned at an outer side of the V-shaped notch.

According to the MC cartridge configured as described above, the pair of right and left flat coils having the perfect circular shapes, which serve as the generating coils, are disposed between the pair of yokes respectively having the V-shaped notch on the opposing surfaces. Further, the pair of right and left flat coils is disposed along the surface of the coil supporting body attached to the front end portion of the cantilever right above the stylus, and thus, it is possible to obtain a large amplitude of the coil.

It is possible to relatively easily form the pair of right and left flat coils having the perfect circular shapes by utilizing the self-bonding wire obtained by, for example, performing enamel coating on a copper wire and the wire is over-coated with the adhesive, and thus, it is possible to obtain the high productivity and the uniform quality by utilizing the generating coil having a simple and perfect circular shape. Accordingly, it is possible to provide the MC cartridge capable of obtaining the high output with the low impedance.

Further, the V-shaped notch is formed on each opposing surface of the pair of yokes, and an angle of such a V-shaped intersection angle is set to an optimal value of equal to or smaller than 90 degrees. Thus, it is possible to set a virtual angle of the magnetic flux considering a leakage magnetic flux to be substantially 90 degrees. Accordingly, it is possible to provide the MC cartridge capable of effectively reducing crosstalk between right and left channels.

The intersection angle is desirably set to be in a range of equal to or larger than 63 degrees and equal to or smaller than 80 degrees, more desirably to be in a range of equal to or larger than 66 degrees and equal to or smaller than 70 degrees.

BRIEF DESCRIPTION OF THE DRAWING

FIG. 2 is an enlarged view of a magnetic circuit and a vibration unit including a pair of right and left coils and the like;

DESCRIPTION OF THE PREFERRED EMBODIMENTS

Figure 1:
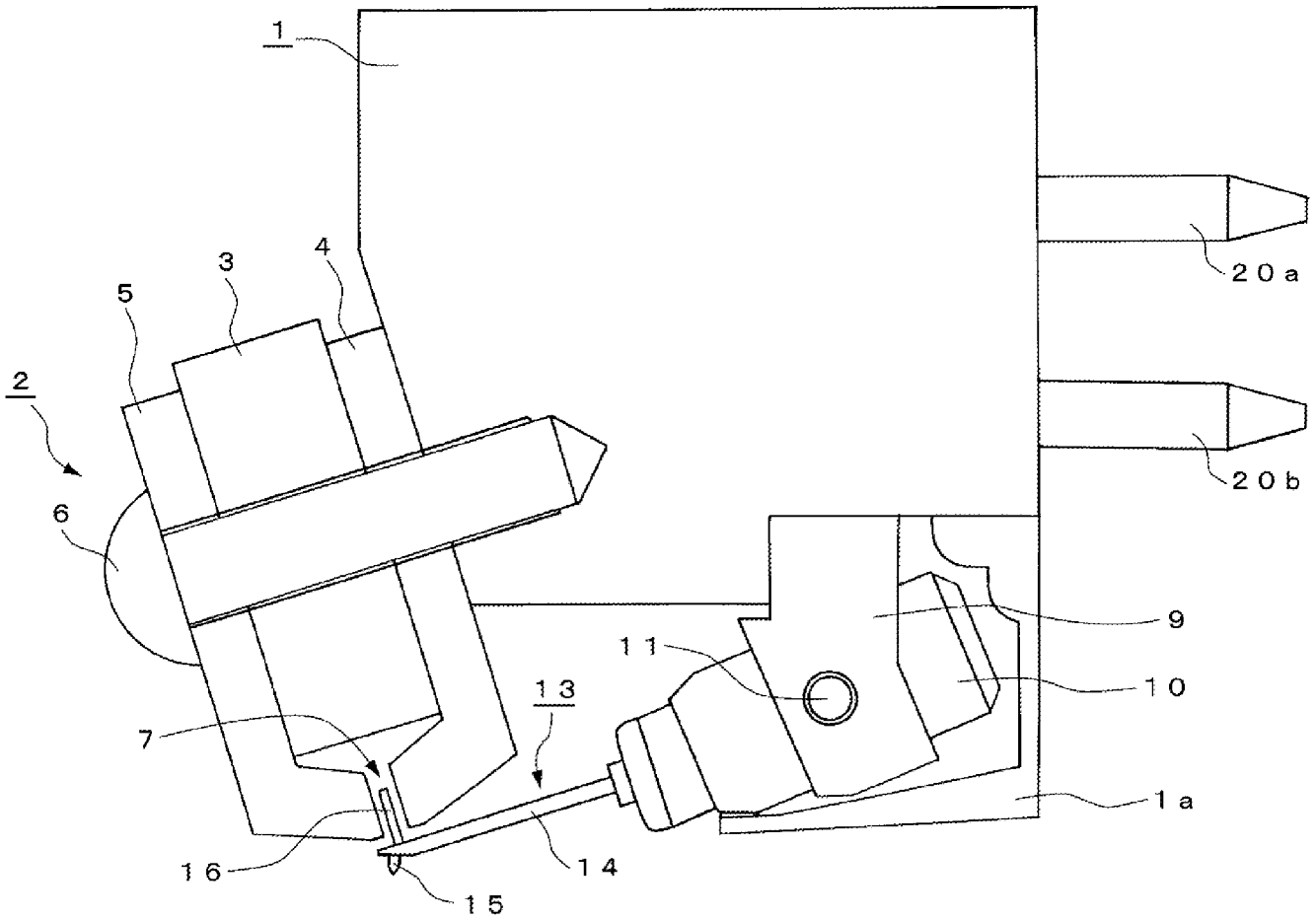
FIG. 1 is a front view illustrating a part of the overall configuration of an MC cartridge according to the invention in perspective state.

A description will be given regarding an MC cartridge according to the invention on the basis of embodiments illustrated in the drawings. Incidentally, it should be noted that, in each drawing to be described hereinafter, the same parts are illustrated using the same reference numerals, but reference numerals are assigned to typical parts in some drawings because of space limitations, and the detailed configurations may be described by quoting reference numerals used in other drawings.

As illustrated in the overall configuration of FIG. 1, the MC cartridge is configured of a vibration unit and a magnetic circuit and a casing that supports the vibration unit and the magnetic circuit when elements thereof are roughly divided.

That is, a prismatic magnet 3 forming a magnetic circuit 2 and a pair of yokes 4 and 5, which are disposed to sandwich the magnet 3 while opposing a magnetic pole of the magnet 3 are attached to a front end portion of a casing 1 using a bolt 6 that penetrates therethrough. Further, as illustrated in FIG. 1, the magnetic circuit 2 is attached to a front surface side of the casing 1 to be slightly downward to correspond to an inclination angle of a front end surface of the casing 1.

Figure 2:
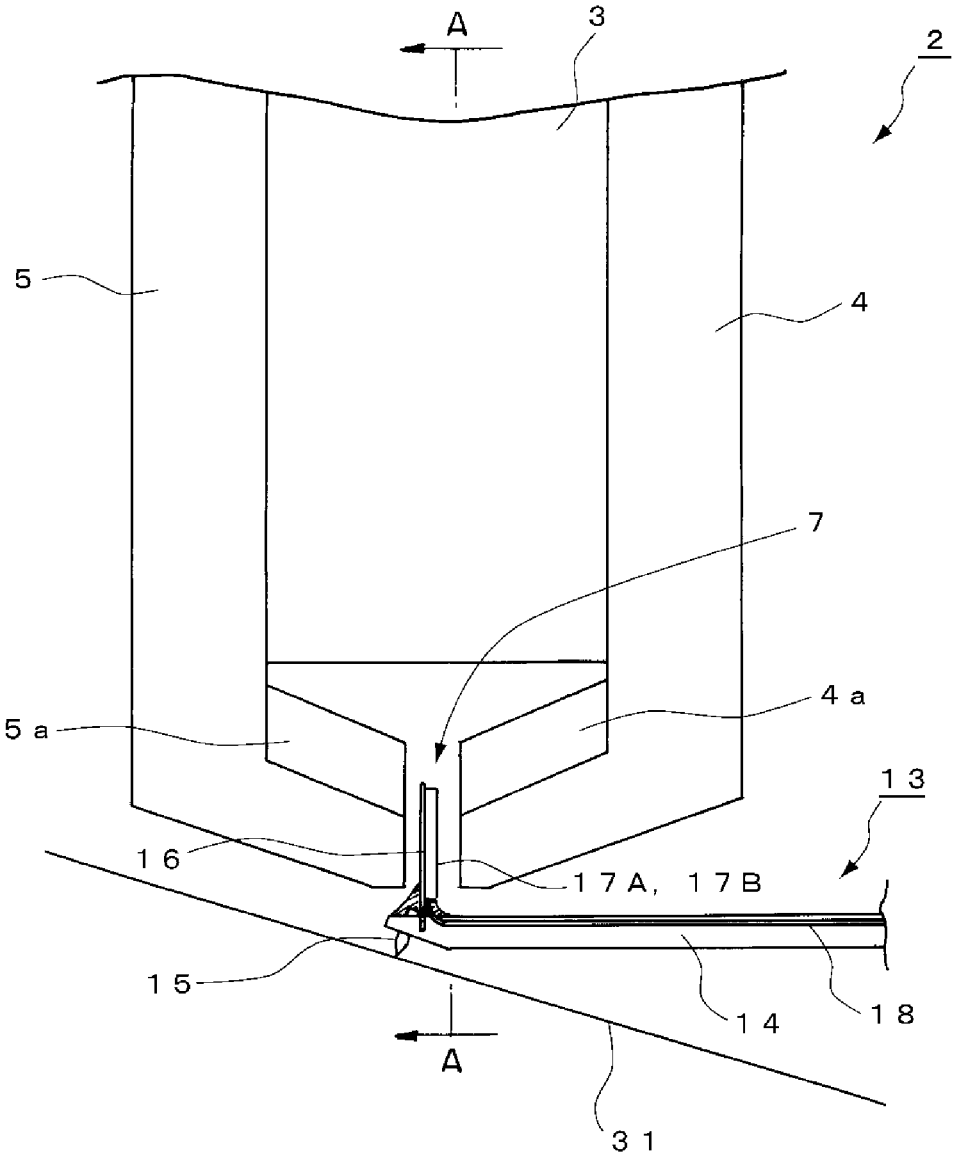

In addition, lower end portions of the pair of yokes 4 and 5 forming the magnetic circuit 2 are formed to be bent to be close to each inner side as illustrated in FIG. 2, and further protruding thick portions 4*a* and 5*a* are formed to oppose each other at the inner sides of the lower end portions of the pair of yokes 4 and 5.

Further, a gap (also referred to as a magnetic gap) 7 is formed by parallel surfaces between the lower end portions of the yokes 4 and 5 and the thick portions 4*a* and 5*a*. Accordingly, a magnetic path is formed by the pair of yokes 4 and 5 that sandwich the magnet 3 and the magnetic gap 7.

Incidentally, the thick portions 4*a* and 5*a* protruding toward the inner sides of the pair of yokes 4 and 5 serve functions of further increasing a magnetic flux density of the magnetic gap 7.

As illustrated in FIG. 1, a space portion is formed between a lower surface of the casing 1 and a bottom surface cover 1*a* attached to a bottom surface of the casing 1. Further, a holder 10, which includes a damper (not illustrated) and the like and is formed in a cylindrical shape, is attached to the space portion using a brace 9 attached to the casing 1.

Incidentally, the holder 10 is attached to the brace 9 such that a front end portion thereof is slightly downward, and a set screw 11 attached to a central portion of the holder 10 serves a function of stopping disengagement of a cantilever to be described later.

The holder 10 supports a vibration unit 13 including a cantilever 14 attached to the front end portion of the holder 10 in a swingable manner, and a stylus 15 is attached downward to a front end portion of the cantilever 14.

Further, as illustrated in FIG. 2, a coil supporting body 16 made of a non-magnetic body such as a resin film is attached to the front end portion of the cantilever 14 right above the stylus 15 so as to be perpendicular to an axial direction of the cantilever 14 using an adhesive, for example, an epoxy resin and the like.

A pair of flat coils 17A and 17B, wound in a perfect circular shape, is disposed in the coil supporting body 16, and the pair of flat coils 17A and 17B disposed in the coil supporting body 16 is configured to be positioned inside the magnetic gap 7.

Incidentally, a line indicated by reference numeral 31 in FIG. 2 illustrates a sound track of a phonograph record that the stylus 15 attached to the front end portion of the cantilever 14 traces.

Figure 3:
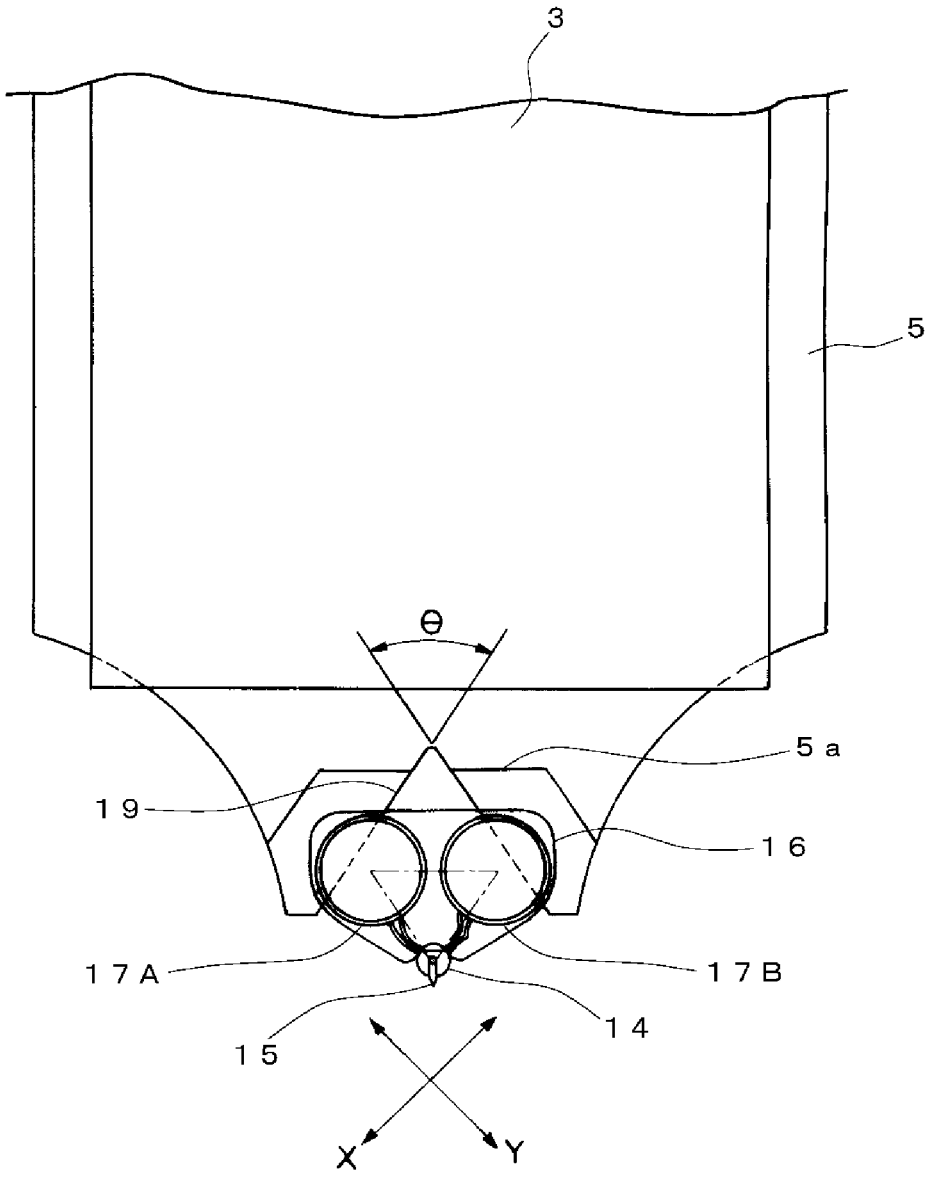
FIG. 3 is a partial cross-sectional view viewed in an arrow direction along a line A-A of FIG. 2.

FIG. 3 illustrates a preferred positional relation between the pair of right and left coils 17A and 17B disposed in the coil supporting body 16, and each V-shaped notch formed in the yokes so as to oppose the magnetic gap 7 formed between the yokes 4 and 5 including thick portions 4*a* and 5*a*.

The pair of right and left coils 17A and 17B is formed by, for example, firmly winding a coated conductor wire (enamel wire) to which an adhesive is attached in the perfect circular shape.

A copper wire with high purity of about ϕ20 μm is preferably used as the coil, and for example, the copper wire is wound by seven turns with ϕ0.9 mm using a cylindrical jig to be molded in a coil shape.

Further, it is possible to mold the flat coils 17A and 17B by allowing the adhesive over-coated to the coated conductor wire to be activated by heat or a solvent such that the coil-like coated conductor wire becomes firm by self-welding.

The flat coils 17A and 17B, each of which is wound to have the perfect circular shape, are attached to the front end portion of the cantilever 14 via the coil supporting body 16 such that each center of the flat coils 17A and 17B and an axial core of the cantilever form an isosceles triangle as indicated by a virtual line (a dashed line) in FIG. 3.

Incidentally, each lead line 18 of the coils 17A and 17B is fixed along a longitudinal direction of the cantilever 14 by an adhesive as illustrated in FIG. 2, and is connected to a terminal pin 20*a* and 20*b* attached to a rear end portion of the casing 1.

According to the flat coils 17A and 17B configured as described above, it is possible to obtain an impedance of about 3 Ω which is an extremely low value.

In addition, since coil supporting body 16 on which the flat coils 17A and 17B are disposed is attached to the front end portion of the cantilever 14 right above the stylus 15, it is possible to obtain a characteristic that the generation efficiency according to the coils 17A and 17B is high, and an output voltage value thereof is 0.15 to 0.25 mV/5 cm.

Incidentally, it is possible to use an aluminum wire, a gold wire, a silver wire, and the like other than the above-described copper wire as a material that forms the coils 17A and 17B described above.

Meanwhile, a V-shaped notch 19 is formed on each of the opposing surfaces of the pair of yokes 4 and 5 including thick portions 4*a* and 5*a* with the coils 17A and 17B described above interposed therebetween, that is, on the opposing surfaces of the yokes 4 and 5 in the magnetic gap 7.

Incidentally, the V-shaped notch formed in the one yoke 5 is indicated by reference numeral 19 in FIG. 3, and the same V-shaped notch is formed at an opposing position also in the other yoke 4.

A positional relation of the pair of coils 17A and 17B, in a state in which a stylus pressure set in advance is applied, with respect to the V-shaped notches 19 formed in the yokes 4 and 5 is preferably a state illustrated in FIG. 3.

That is, the coils 17A and 17B are positioned between the opposing yokes 4 and 5 such that there are apart that intersects the magnetic flux (the part to cut the magnetic flux) and apart that does not cut the magnetic flux due to the V-shaped notch 19.

In this case, a leakage magnetic flux is generated along the V-shaped notch 19, and thus, each center of the coils 17A and 17B having the perfect circular shapes is preferably set to be positioned at a slightly outer side of the V-shaped notch 19 as illustrated in FIG. 3.

In such a state, the stylus 15 traces the sound track of the phonograph record, and the coils 17A and 17B vibrate in directions of arrows X and Y. Accordingly, electromotive forces to be generated when the coils 17A and 17B cross the magnetic flux are taken out as right and left output signals.

Meanwhile, according to the above-described configuration, the leakage magnetic flux is generated along the V-shaped notch 19 formed in each of the yokes 4 and 5, and a magnetic flux density of the leakage magnetic flux is known to be high near an apex the V-shaped notch and to be low near slopes of the V-shaped notch.

Accordingly, in a case in which an intersection angle θ of the V-shaped notch 19 is set to, for example, 90 degrees, an isopycnic line of the magnetic flux (a virtual angle of the magnetic flux) according to the leakage magnetic flux is substantially wider than 90 degrees due to an imbalanced distribution of the leakage magnetic flux described above, which becomes a factor to generate the crosstalk.

That is, in a case in which the coil supporting body 16 is vibrated to be displaced in the direction of the arrow X, for example, in FIG. 3, there is a difference in the crossing magnetic flux density between near the apex and the slopes of the V-shaped notch 19 in the coil 17A although the electromotive force is not necessarily generated in the coil 17A, and the difference causes the crosstalk.

Similarly, in a case in which the coil supporting body 16 is vibrated to be displaced in the direction of the arrow Y, for example, there is a difference in the crossing magnetic flux density between near the apex and the slopes of the V-shaped notch 19 in the coil 17B although the electromotive force is not necessarily generated in the coil 17B, and the difference causes the crosstalk.

Accordingly, it is possible to obtain the MC cartridge with small crosstalk by setting the intersection angle θ of the V-shaped notch 19 to be formed in each of the yokes 4 and 5 to be equal to or smaller than 90 degrees, and setting the isopycnic line of the magnetic flux according to the leakage magnetic flux caused along the V-shaped notch 19 to be substantially 90 degrees.

Figure 4:
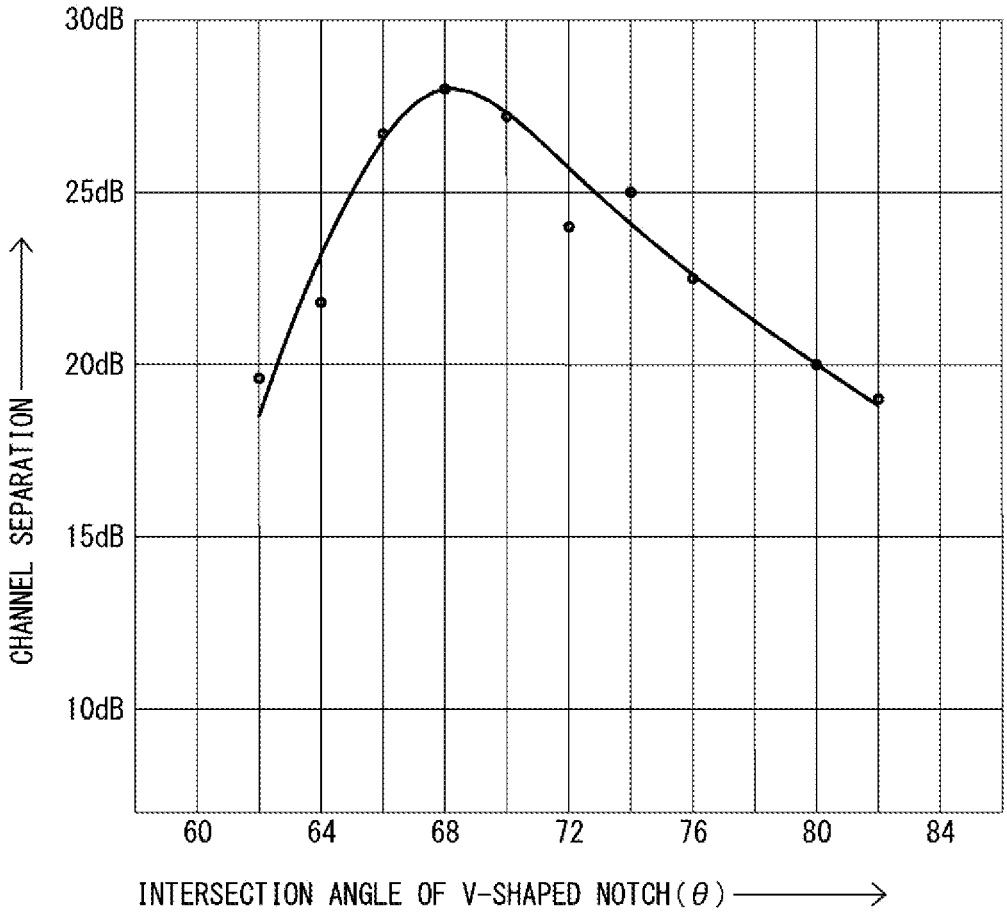
FIG. 4 is a characteristic diagram illustrating a relation between an intersection angle of a V-shaped notch formed in a yoke and crosstalk (channel separation).

FIG. 4 illustrates a crosstalk characteristic with respect to an intersection angle of the V-shaped notch 19 formed in the yokes 4 and 5 in which a horizontal axis represents the intersection angle θ of the V-shaped notch 19, and a vertical axis represents a value of channel separation of a signal output of 1 kHz substituting for the crosstalk characteristic.

As illustrated in FIG. 4, it is possible to obtain the most favorable crosstalk characteristic (channel separation is equal to or larger than 27 dB) near the intersection angle θ of the V-shaped notch 19 being 66 to 70 degrees.

Further, the channel separation is equal to or larger than 20 dB when the intersection angle θ of the V-shaped notch 19 is 63 to 80 degrees, and it is possible to say that such a range can be preferably employed in practical application as the MC cartridge.

As above, according to the MC cartridge of the present invention, it is possible to obtain the high productivity and the uniform quality by utilizing the generating coil having the simple and perfect circular shape. It is possible to provide the MC cartridge capable of obtaining the high output with the low impedance.

Further, it is possible to provide the MC cartridge excellent in the crosstalk characteristic by setting the intersection angle θ of the V-shaped notch, which is formed in each opposing yoke, to be in a range of 63 to 80 degrees. Therefore, it is possible to obtain the action and effect as described in the field of summary.

What is claimed is:

1. A moving-coil type stereo pickup cartridge comprising:

a vibration unit which includes a cantilever, a stylus attached to the cantilever, and a pair of right and left coils each having a circular shape that is attached to the cantilever and vibrates in response to a vibration of the stylus; and a magnetic circuit which includes a magnet and a pair of yokes having a gap therebetween to dispose the pair of right and left coils, and forms a magnetic path passing through the gap, wherein V-shaped notches are formed respectively on opposing surfaces, with the pair of right and left coils interposed therebetween, of the pair of yokes, and an intersection angle θ of the V-shaped notch is in a range of equal to or larger than 66 degrees and equal to or smaller than 70 degrees so that the pair of right and left coils obtains a channel separation between right and left output signals to be equal to or larger than 20 db.

2. The moving-coil type stereo pickup cartridge according to claim 1, wherein the pair of right and left coils is formed by firmly winding a coated conductor wire to which an adhesive is attached in a circular shape.

3. The moving-coil type stereo pickup cartridge according to claim 1, wherein each of the pair of right and left coils includes a part that intersects a magnetic flux caused by the magnetic path and a part that does not cut the magnetic flux due to the V-shaped notch.

4. The moving-coil type stereo pickup cartridge according to claim 1, wherein the pair of yokes each includes a thick portion formed on an inner side thereof at a gap portion between the pair of yokes.

5. The moving-coil type stereo pickup cartridge according to claim 4, wherein each center of the pair of right and left coils is positioned at an outer side of the V-shaped notch.

6. The moving-coil type stereo pickup cartridge according to claim 1, wherein the pair of right and left coils is disposed along a surface of a coil supporting body made of a non-magnetic body attached to a front end portion of the cantilever directly above the stylus.

7. The moving-coil type stereo pickup cartridge according to claim 6, wherein the pair of right and left coils is disposed on the coil supporting body such that each center of the pair of right and left coils having the circular shapes and an axial core of the cantilever form an isosceles triangle.

8. The moving-coil type stereo pickup cartridge according to claim 7, wherein the pair of right and left coils is formed by firmly winding a coated conductor wire to which an adhesive is attached in a circular shape.

9. The moving-coil type stereo pickup cartridge according to claim 6, wherein the pair of right and left coils is formed by firmly winding a coated conductor wire to which an adhesive is attached in a circular shape.

10. The moving-coil type stereo pickup cartridge according to claim 6, wherein the front end portion of the cantilever includes a tapered portion tapered at a bottom side of the cantilever so that a cross-section of the front end portion of the cantilever gradually reduces in an axial direction of the cantilever toward the front end portion, and the tapered portion is attached to the stylus at the bottom side and attached to the pair of right and left coils at an upper side opposite to the bottom side.

11. The moving-coil type stereo pickup cartridge according to claim 10, wherein the vibration unit further comprises a coil supporting body made of a non-magnetic material extending from the upper side of the tapered portion and directly above the stylus toward the gap to support the pair of right and left coils between the pair of yokes.

12. The moving-coil type stereo pickup cartridge according to claim 11, wherein the pair of yokes each have a first portion and a second portion extending downward from the first portion, the first portions extend in parallel to each other to hold the magnet therebetween, the second portions extend toward each other and form a space between inner side surfaces of the second portions and the magnet, the space communicating with the gap, and the second portions each include a thick portion protruding inside the space and toward the magnet from the inner side surface thereof for increasing a magnetic flux density of the gap.

* * * * *